US005791434A

United States Patent [19]

Swiderski

[11] Patent Number: 5,791,434

[45] Date of Patent: Aug. 11, 1998

[54] MOBILE WAREHOUSE LADDER

[75] Inventor: Paul R. Swiderski, County of Scott, Ky.

[73] Assignee: Emerson Electric Co., St. Louis, Mo.

[21] Appl. No.: 752,608

[22] Filed: Nov. 19, 1996

[51] Int. Cl.[6] ..... E06C 5/00

[52] U.S. Cl. ..... 182/17; 182/15

[58] Field of Search ..... 182/12–7, 17

[56] References Cited

U.S. PATENT DOCUMENTS

| | | | |
|---|---|---|---|
| 2,521,114 | 9/1950 | Campbell | 182/12 |
| 2,624,590 | 1/1953 | Tilton | 182/17 |
| 3,155,190 | 11/1964 | Borgman . | |
| 3,175,641 | 3/1965 | Mihalik . | |
| 3,291,254 | 12/1966 | Mihalik . | |
| 3,684,055 | 8/1972 | Rice | 182/17 |
| 4,044,857 | 8/1977 | Guerette . | |
| 4,063,616 | 12/1977 | Gutierrez . | |

*Primary Examiner*—Alvin C. Chin-Shue

*Attorney, Agent, or Firm*—Polster, Lieder, Woodruff & Lucchesi

[57] ABSTRACT

A mobile ladder arrangement including base, ladder and linkage and caming assemblies therebetween to provide a foot actuated ladder assembly secured "use mode" and a hand actuated ladder assembly "mobile mode".

11 Claims, 4 Drawing Sheets

MOBILE WAREHOUSE LADDER

STATEMENT REGARDING FEDERALLY SPONSORED RESEARCH OR DEVELOPMENT

Not Applicable.

CROSS-REFERENCE TO RELATED APPLICATIONS

Not Applicable

BACKGROUND OF THE INVENTION

The present invention relates to a mobile ladder arrangement and more particularly to a unique ladder assembly structure which can be readily adjusted alternatively for "mobile mode" and for "use mode".

Mobile ladder structures are generally well known in the art. In this regard, attention is directed to U.S. Pat. No. 3,155,190, issued to A. C. Borgman on Nov. 3, 1964; U.S. Pat. No. 3,175,641, issued to R. J. Mihalik on Mar. 30, 1965; and to U.S. Pat. No. 3,291,254, issued to R. J. Mihalik on Dec. 13, 1966. Each of these expired patents teaches a comparatively complex, foot actuated, spring biased mechanism to place base frame mounted casters alternatively in ladder mobile and ladder use conditions. Attention is further directed to U.S. Pat. No. 4,044,857, issued to M. Guerette on Aug. 30, 1977, which teaches a similar ladder assembly mechanism with actuating and retracting foot pedals for alternative mobile and use positions and to U.S. Pat. No. 4,063,616, issued to E. F. Gutierrez on Dec. 20, 1977, which teaches a ladder assembly mechanism which discloses a two position single actuating mechanism to place a ladder assembly alternatively into ladder use and ladder mobile condition.

For the most part, these past mechanisms have been comparatively complex in their construction assembly, use and maintenance, often requiring finely tooled parts and further requiring substantial operating pressures to move from one ladder assembly operating position to another.

In accordance with the present invention, many of the past manufacturing, assembly and operation problems are recognized and eliminated, the present invention providing a mobile ladder structure which is straightforward and economical in manufacture, assembly and maintenance. In addition, the present invention provides a mobile ladder structural arrangement which minimizes the operating pressures required to move between alternative mobile and use positions, further utilizing the inherent weight and mass of the ladder structure in accomplishing functional changes.

Further, the present invention, recognizing the possibilities that certain interference problems can arise with movement and use of a heightened, large mass structure, attempts to minimize the risk of such problems by the use of selected insulation materials when the inventive ladder structure assembly is placed in transient use.

Various other features of the present invention will become obvious to one skilled in the art upon reading the disclosure set forth herein.

BRIEF SUMMARY OF THE INVENTION

More particularly the present invention provides a mobile ladder structure including a supporting base assembly, the ladder structure being selectively adjustable between a ladder structure fixed stationary "use mode" and a ladder structure movable "mobile mode" comprising a base frame having at least first and second caster wheel means mounted in spaced relation on the base frame to provide selective mobility to the base frame with at least one caster wheel means being movably adjustable relative the base frame between the ladder structure "use mode" and the ladder structure "mobile mode"; linkage assembly means including a movable, longitudinally extended hand level actuating lever arm mounted to the ladder structure at one end of the linkage means and to the movably adjustable caster wheel means at the opposite end of the linkage means to movably adjust the caster wheel means from the "use mode" to the "mobile mode"; and foot level movable caming and securing means independently cooperable with the linkage assembly means to return and secure the movable adjustable caster wheel means to a "use mode" after movement of the ladder structure in a "mobility mode" to a preselected location.

In addition the present invention provides for a unique way to minimize electrical conductivity of the ladder structure in likely locations where transient movement of equipment and user contact most often occur without sacrificing strength or mobility.

It is to be understood that various changes can be made by one skilled in the art in one or more of the several parts of the inventive apparatus disclosed herein without departing from the scope or spirit of the present invention.

For example, although a six unit spaced caster arrangement is disclosed herein, it would be possible to employ the inventive features on other spaced caster arrangements, such as a single unit and spaced two caster unit arrangement or other combinations of spaced caster units so as long as ladder structure stability is maintained in keeping with the size and geometry of the overall structure.

Further, other types of linkage arrangements besides the disclosed "lazy tong" type arrangement disclosed could be used—as could the types and particular locations of selected insulation materials.

BRIEF DESCRIPTION OF THE SEVERAL VIEWS OF THE DRAWINGS

Referring to the drawings which disclose one advantageous embodiment of the unique mobile ladder structure of the present invention.

In the drawings.

DETAILED DESCRIPTION OF THE INVENTION

Figure 1:
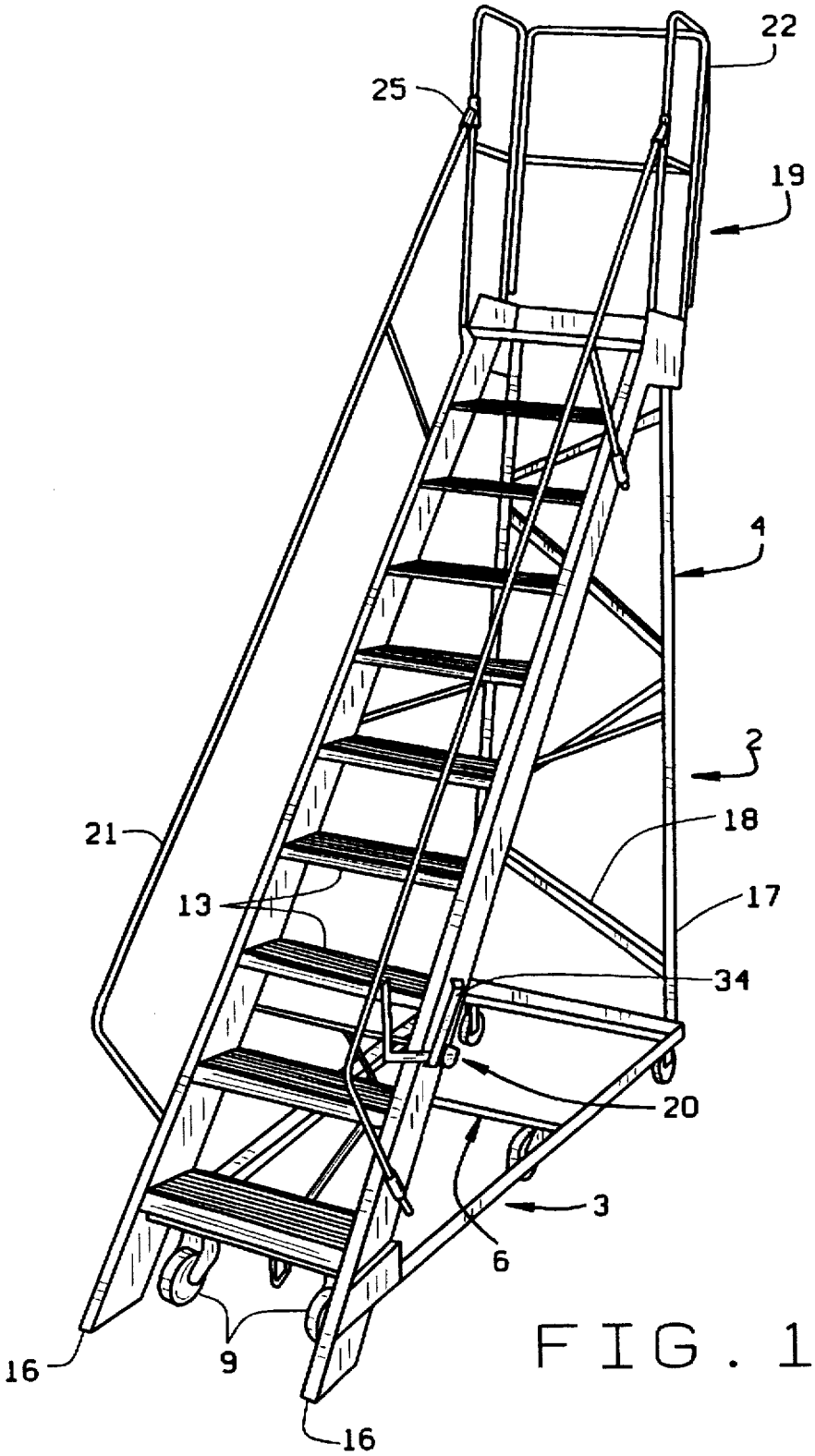
FIG. 1 is an isometric view of the overall inventive ladder structure.

Referring to FIG. 1 of the drawings, the inventive mobile ladder structure 2 is disclosed as including, a base assembly 3, a warehouse ladder assembly 4 and a linkage and caming assembly 6. The linkage and caming assembly 6 (which is more fully disclosed in FIGS. 2 and 3 of the drawings) is selectively cooperable and adjustable between the base assembly 3 and the warehouse ladder assembly 4 so as to provide a warehouse ladder assembly "use mode", as disclosed more fully in FIG. 3 of the drawings, and a warehouse ladder assembly "mobile", as disclosed more fully in FIG. 2 of the drawings.

Figure 2:
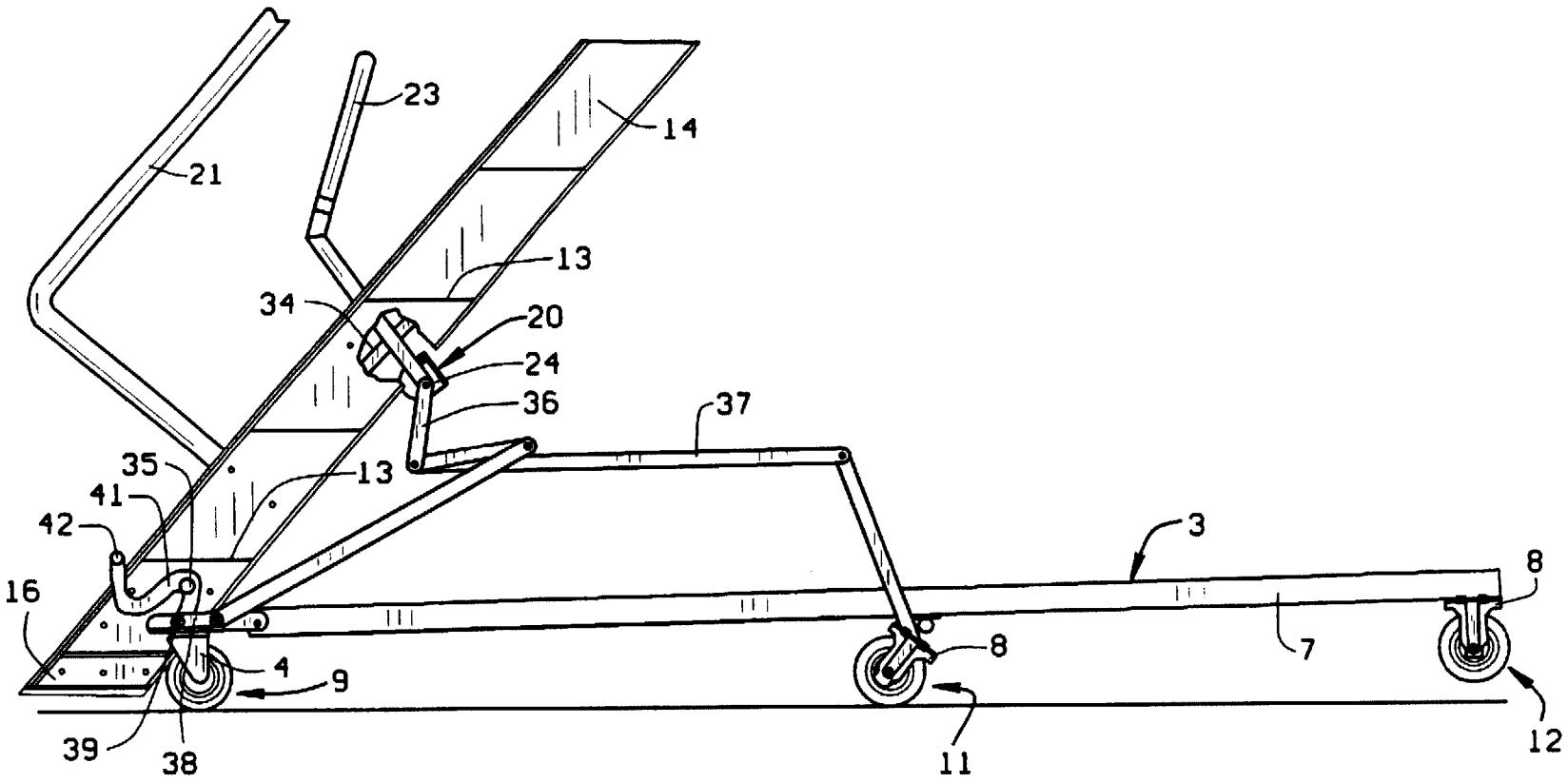
FIG. 2 is an enlarged schematic side view of a portion of the structure of FIG. 1, disclosing the ladder structure in a "mobile mode" condition.
Figure 3:
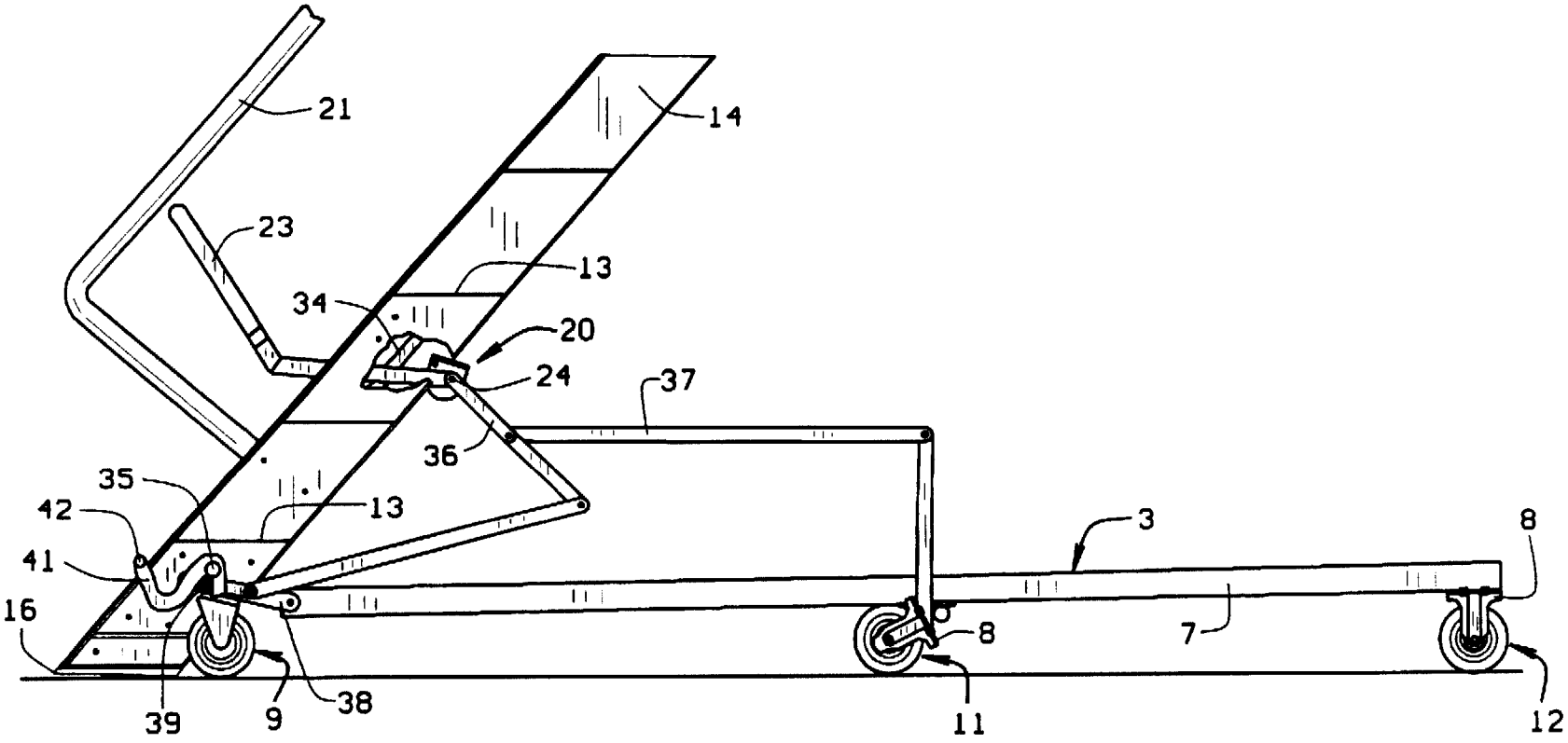
FIG. 3 is an enlarged, schematic view similar to the view of FIG. 2, disclosing the structure in a "use mode" condition.

As can be seen particularly in FIGS. 2 and 3 of the drawings, and also in FIG. 1, base assembly 3 includes a substantially rectangular base 7 having three spaced pairs of rubber wheel caster units 8 mounted on the base frame 7 in spaced relation to provide front, intermediate and rear caster rubber wheel pair sets 9, 11, and 12 respectively. It is to be understood that although base frame 7 as disclosed herein is of a substantially rectangular geometric shape with only a minor taper from front to rear, it would be possible to use other geometries, depending upon the anticipated use, size, height and weight of the stable ladder structure needed. It further is to be understood that although the ladder structure disclosed herein is of a three spaced caster pair sets arrangement, other spaced caster set arrangements could be utilized without departing from the scope or spirit of the present invention. For example, with smaller and lighter ladder structures, it would be possible to employ only (2) two pair sets of casters or even a spaced three caster wheel arrangement or a two caster wheel and a fixed rest could be employed for reduced size equipment without sacrificing ladder structure stability. In the embodiment of the invention disclosed, each pair of rubber casters wheels of a caster wheel pair set are mounted at opposed ends of a suitable axle and supported in a caster wheel support frame with the front caster wheel pair set 9 and the spaced intermediate caster wheel pair set 11 being movably adjustable relative base frame 7 and the rear caster wheel pair set 12 being fixedly supported relative base frame 7. It further is to be understood that base frame 7 can be formed from any one of a number of suitably strong materials, such as structural steel with the caster wheel pair set support frames, axles, and wheel rims also being of a suitably strong metallic material to accommodate the rubber caster wheel mounted on the wheel rims.

The warehouse ladder assembly 4 as disclosed in the drawings, includes spaced steps 13 supported between upwardly sloping substantially parallel, longitudinally extending spaced stringers 14. The steps 13 can be any one of a number of known, strong, light weight supporting materials and advantageously, can be formed from extruded aluminum. Any preselected number of steps can be utilized, depending upon the size and geometry of the ladder to be employed, with nine (9) such spaced steps being shown in the embodiment disclosed in FIG. 1 of the drawings. The steps can be fastened to spaced stringers 14 in any one of a number of ways known in the art and, in the embodiment disclosed the step flanges are riveted to the side flanges of the stringers 14. In accordance with one feature of the present invention the stringers 14 can be formed from electrically insulative fiberglass material and, as can be seen, in FIGS. 1–3 of the drawings, each stringer 14 is provided with a rubber resting boot 16 fastened to the bottom end at the stringer.

Again, referring to FIG. 1, the warehouse assembly 4 includes a spaced, substantially vertically extending, braced back structure 17 and intermediate bracing structure 18. The back structure 17 can be made of a suitably strong, insulated material such as reinforced fiberglass and the bracing structure 18 can be of extruded aluminum or other suitably strong material.

A support platform 19 (FIG. 1) is fastened to and between the upper extremities of the stringers 14 and the vertically extending back structure 17. In accordance with still another feature of the present invention, like stringers 14, support platform 19 can be of a suitably strong, insulated fiberglass material and the sloping fiberglass stringers 14 and fiberglass platform 19 are provided with suitably insulated materials such as coated (PVC) steel with step and platform guard rail assemblies 21 and 22 respectively being fastened along the side edges thereof. In this regard, it is to be noted that step guard rails 21 can be connected to platform guard rails 22 by electrically insulted connectors 25, which can be appropriately selected plastic and which are shaped to each engagingly surround a portion of platform guard rail 22 and telescopically receive an end of guard rail 21.

Figure 4:
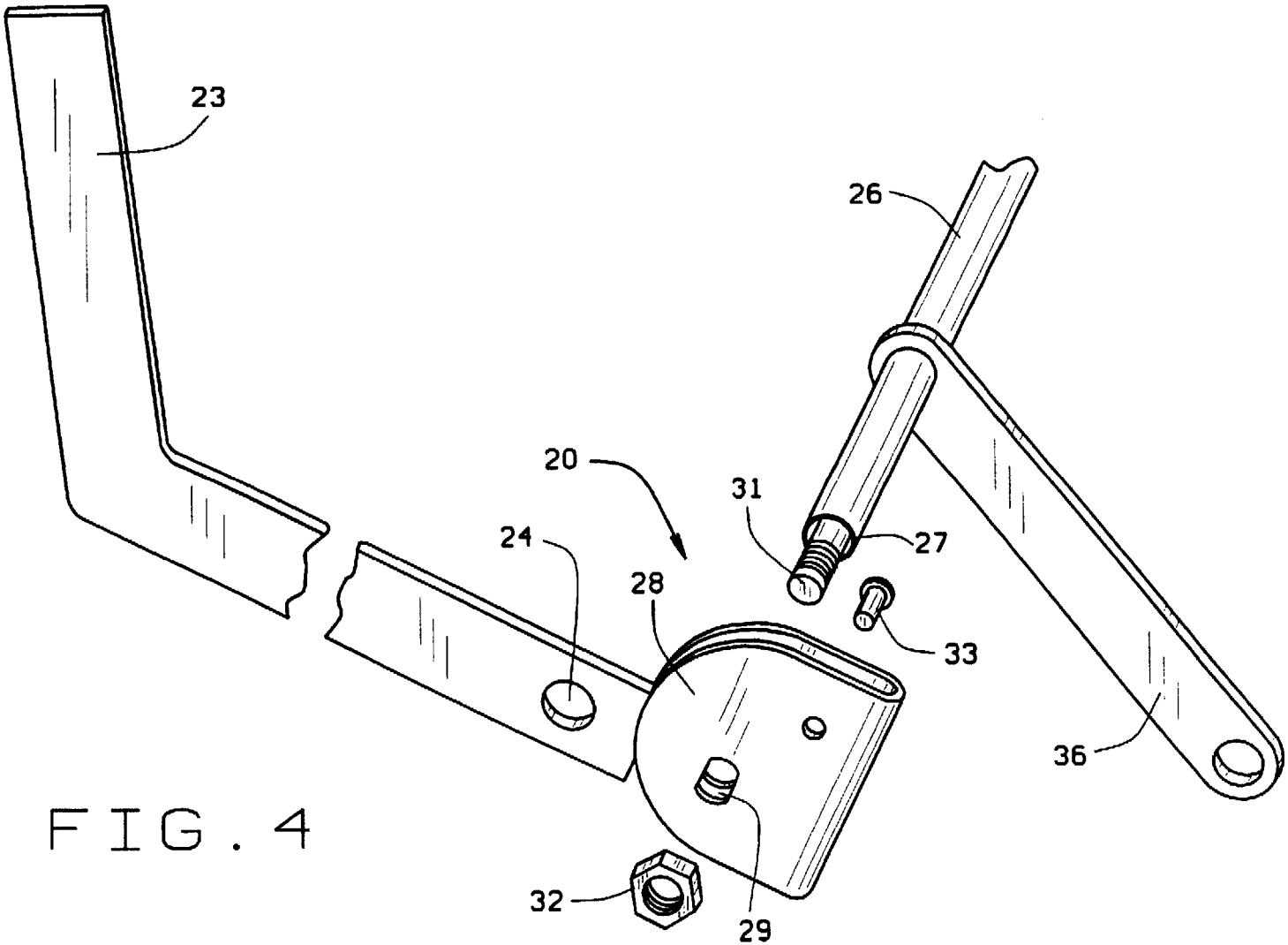
FIG. 4 is an enlarged, schematic, exploded isometric view of a portion of the linkage assembly, disclosing the unique hand actuable lever of the ladder structure of FIGS. 1–3.

As can be seen in FIGS. 2–4 of the drawings—particularly FIG. 4-, the linkage and caming assembly is provided with a lost-motion, unidirectional drive connector assembly 20. Drive connector assembly 20 includes at one end thereof a longitudinally extending, manually actuable, lever arm 23. Lever arm 23 is provided with an appropriately sized aperture 24 at the axle engaging end thereof. Aperture 24 is sized to engage with and rotate freely about one end of linkage and caming axle 26. Referring to FIG. 4, it can be seen that linkage and caming axle 26 is provided at that extremity freely engaged by aperture 24 of lever arm 23 with a key or spline portion 27 geometrically sized and shaped with opposed mirror image curved surfaces to engagingly and rotationally accommodate aperture 24 of lever arm 23 for free rotation of lever arm 23 thereon. Surroundingly fixed to the same extremity of linkage and caming axle 26 which is engaged by lever arm 23 is an off-center axle drive member 28 of U-shaped cross-section. Aligned and appropriately shaped apertures 29 are provided in the spaced flanks of off-center drive member to snugly receive key portion 27 of axle 26 fixing drive member 28 to axle 26. The extremity of axle 26 includes a threaded tip portion 31 engaged by threaded stop nut 32 to firmly hold drive member 28 in place. Fastened to the opposed, spaced flanks of drive member 28 in offset relation to the longitudinal axis of axle 26 is a stop member 33 which can be in the form of a rivet member extending between the spaced drive member flanks. Accordingly, when lever arm 23 is manually activated to freely rotate about key or spline portion 27 at the extremity of linkage and caming axle 26, it abuts against this offset stop member 33, thus causing the axle 26 to be rotatingly activated about its longitudinal axis and thus moving the linkage assembly in a manner described hereinafter to place the structure in a "mobile mode". When manually released, the extended lever arm 23 then falls back in a counter-clockwise direction by gravity to a "limp position" and further movement of the lever arm 23 is restrained by a U-shaped bracket 34 which freely surrounds the lever arm to be fastened to a side of stringer 14. It is to be understood that a suitable compression spring (not shown) can be utilized with lever arm 23 to assist lever arm 23 in counter clockwise rotation.

It is to be noted that axle 26 is connected through an insulated link 36 to one end of a lazy tong linkage arrangement 37 which, in turn, is connected to front caster wheel pair set 9 through a side plate 38 and to the movable intermediate caster wheel pair set 11 at the opposite end of lazy-tong linkage 37. It is to be understood that the present invention is not to be considered as limited to the particular lazy-tong linkage arrangement 37 as shown but that other scissor-type linkage arrangement could also be employed. It is also to be understood that with the clockwise pivotal movement of extended lever arm 23, the movement of linkage 36 and 37 causes the connected front and intermediate moveable caster sets to pivot from a restricted "use mode" position so as to place the ladder structure in a "mobile mode" with the rear caster set 12 and front resting boot 16 being elevated from "use mode" ground level.

Simultaneously, a pin 39 on side plate 38 connected to the moveable front caster wheel pair set 9, which has been placed in "mobile mode", comes to rest at one extremity of "S-shaped" cam 41, which cam 41 is pivotally mounted on pin 35 extending between stringers 14. With the front and intermediate caster wheel pair sets 9 and 11 so positioned on the ground, pivoted S-shaped cam 41 is maintained in an unnested, unsecured position. It is to be noted the opposite extremity of pivotal S-shaped cam 41 is connected to a foot actuating bar 42 located adjacent the level of the first step 13 of the sloping ladder assembly 4. By stepping on this bar 42, S-shaped cam 41 rotates in a counter-clockwise direction and the restrained pin 39 on side plate 38 associated with lazy-tong linkage 37 moves to a cam nesting, secured "use mode" condition with the overall weight of the mobile ladder structure 2 causing boot resting end 16 and rear caster set 12 to engage the floor and placing the ladder structure in a stable, "use mode" condition.

Thus, in accordance with the above-described arrangement, a unique and novel mobile ladder structure is provided which is straightforward and economical in manufacture, assembly, operation and maintenance, requiring a minimum of operating leverage pressure through extended hand operated lever arm 23 to move from "mobile mode" to "user mode" and at the same time insulating those parts which are most likely to make undesirable contacts during transient movement on the structure and of the structure itself and at the same time enhancing insulation.

I claim:

1. A mobile ladder structure including a supporting base assembly, a warehouse ladder assembly mounted on said supporting base assembly and a linkage and caming assembly selectively cooperable and adjustable between said supporting base assembly and said warehouse ladder assembly to provide a warehouse ladder assembly fixed stationary "use mode" and a warehouse ladder assembly movable "mobile mode" comprising:

a base assembly including a substantially rectangular base frame having three spaced pairs of wheeled casters mounted thereon in spaced relation to provide front, intermediate and rear caster rubber wheel pair sets with said front and intermediate caster rubber wheel pair sets being adjustably movable relative said base frame and with said rear caster rubber wheel pair set being in fast and fixed relation with respect to said base frame;

a warehouse ladder assembly including spaced steps supported between upwardly sloping substantially parallel, longitudinally extending fiberglass spaced stringers having a rubber resting boot at the bottom end thereof, said warehouse assembly further including a spaced substantially vertically extending back structure and an intermediate bracing structure with a fiberglass support platform fastened to and between the upper extremities of said spaced stringers and said vertically extending back structure, said spaced stringers and said fiberglass support platform having insulating coated guard rails mounted thereon;

said linkage and caming assembly including at one end thereof a longitudinally extending manually hand level actuable lever arm pivotally connected thereto through a lost-motion unidirectional off-center drive connector assembly to a rotatable axle forming part of said linkage and caming assembly for movement in one direction upon movement of said lever arm, with one of said spaced stringers of said warehouse ladder assembly including a restraining bracket mounted thereon to freely surround said lever arm and limit "limp" gravity return in the opposite direction of said lever arm after movement to said "mobile mode" of said warehouse ladder assembly, the linkage of said linkage and caming assembly being connected through a fiberglass link to a lazy-tong type pivotal linkage arrangement having one extending link arm thereof connected through a fiberglass link to said adjustably movable front caster rubber wheel pair set and a second link arm connected to said adjustably moveable spaced intermediate caster rubber wheel pair set whereby clockwise movement of said longitudinally extending manually hand level actuable lever arm causes said adjustably movable front and intermediate caster wheels to simultaneously move to said warehouse ladder assembly "mobile mode;"

said caming structure of said linkage and caming assembly including an "S-shaped" caming member pivotally mounted between said stringers with one extremity thereof connected to a foot actuable bar and the inner extremity thereof adapted to restrainingly abut said linkage assembly when in said "mobile mode" and to nest with and secure said linkage assembly when pivoted counter-clockwise by foot actuation with the front and intermediate caster wheel pair sets simultaneously secured to be inoperative and the warehouse ladder assembly weight resting by gravity in secured position on said front boot and said base fixed rear caster rubber wheel pair set.

2. The mobile ladder structure of claim 1, said off-center drive connector assembly for said rotatable axle being mounted to a spline member formed at one end portion of said rotatable axle and having a stop member fixed thereof in off-set relation to the rotational axis of said axle whereby hand level rotational movement of said lever arm in one direction results in engagement with said off-set stop member and the rotational movement of said axle about its longitudinal axis.

3. A mobile ladder structure including a supporting base assembly, said ladder structure being selectively adjustable between a ladder structure fixed, stationary "use mode," and a ladder structure movable "mobile mode" comprising:

a base frame having at least first and second caster wheel means mounted in spaced relation on said base frame to provide selective mobility to said base frame with at least one of said caster wheel means being movably adjustable relative said base frame between said ladder structure "use mode" and said ladder structure "mobile mode;"

linkage assembly means including a movable extended, hand level actuating lever arm mounted to said ladder structure at one end of said linkage assembly means and to said movably adjustable caster wheel means at the opposite end of said linkage means to movably adjust said caster wheel means from said "use mode" to said "mobile mode;"

and foot level movable caming and securing means independently cooperable with said linkage assembly means to return and secure said moveable adjustable caster wheel means to said fixed stationary "use mode" after movement of said ladder structure in said movable "mobile mode" to a preselected location, wherein said ladder structure includes a ladder assembly with spaced steps supported between spaced longitudinally extending stringers, said movable extended hand actuating lever arm being pivotally mounted and manually operable on one of said stringers of said ladder assembly.

4. The mobile ladder structure of claim 3, wherein said movable extended, actuating lever arm is pivotally hand operable to said "mobile mode" and said securing means is pivotally foot operable to said "use mode".

5. The mobile ladder structure of claim 3, wherein said movable extended, actuating lever arm includes means to gravity return said lever arm to a restrained "limp" non-actuating position after placing said ladder structure in said "mobile mode."

6. The mobile ladder structure of claim 3, wherein said base frame includes a pair of spaced front wheel casters, a pair of spaced intermediate wheel casters and a pair of spaced rear wheel casters, said spaced front wheel casters and said pair of intermediate wheel casters being connected to said linkage assembly to be placed in ground engaging, ladder structure wheel contact when in said movable "mobile mode" with said ladder structure and spaced rear wheel casters being spaced from said ground to be placeable in secured ground contact along with said ladder structure and said spaced rear wheel casters when in said fixed stationary "use mode."

7. The mobile ladder structure of claim 3, wherein said ladder structure comprises a warehouse-type ladder assembly including spaced steps supported between spaced upwardly sloping, substantially parallel, longitudinally extending stringers with a spaced substantially vertically extending back structure and intermediate bracing structure and with a support platform fastened to the upper extremities of said sloping stringers and back structure, said ladder structure being fastened to said base frame.

8. The mobile ladder structure of claim 8, at least said support platform being electrically insulated.

9. The mobile ladder structure of claim 8, said steps and support platform including guard rails with the guard rails of said steps being connected to the guard rails of said support platform by electrically insulated connectors.

10. The mobile ladder structure of claim 3, said moveable extended actuating lever arm being electrically insulated from the remainder of said linkage assembly means.

11. A mobile ladder structure including a supporting base assembly, said ladder structure being selectively adjustable between a ladder structure "first mode," and a ladder structure "second mode" comprising:

a base frame having at least first and second caster wheel means mounted in spaced relation on said base frame to provide selective mobility to said base frame with at least one of said caster wheel means being movably adjustable relative said base frame between said ladder structure "first mode" and said ladder structure "second mode;"

linkage assembly means including a movable extended, hand level actuating lever arm mounted to said ladder structure at one end of said linkage assembly means and to said movably adjustable caster wheel means at the opposite end of said linkage means to movably adjust said caster wheel means from one of said modes to the other of said modes;

and foot level movable caming and securing means independently cooperable with said linkage assembly means to return and secure said moveable adjustable caster wheel means to the other of said modes, wherein said ladder structure includes a ladder assembly with spaced steps supported between spaced longitudinally extending stringers, said movable extended hand actuating lever arm being pivotally mounted and manually operable on one of said stringers of said ladder assembly.

* * * * *

UNITED STATES PATENT AND TRADEMARK OFFICE

CERTIFICATE OF CORRECTION

PATENT NO : 5,791,434

DATED : August 11, 1998

INVENTOR(S) : Paul R. Swiderski

It is certified that error appears in the above-identified patent and that said Letters Patent is hereby corrected as shown below:

Col. 7, line 29
replace "8"
with --7--.

Col. 7, line 31
replace "8"
with --7--.

Signed and Sealed this

Ninth Day of February, 1999

*Attest:*

*Acting Commissioner of Patents and Trademarks*

*Attesting Officer*